US005961336A

United States Patent [19]

Finlay

[11] Patent Number: 5,961,336

[45] Date of Patent: Oct. 5, 1999

[54] ELECTRICAL OUTLET SAFETY DEVICE

[76] Inventor: Barry Finlay, 41 Samoset St., Dorchester, Mass. 02124

[21] Appl. No.: 08/909,774

[22] Filed: Aug. 12, 1997

Related U.S. Application Data

[63] Continuation-in-part of application No. 08/780,874, Jan. 9, 1997, abandoned.

[51] Int. Cl.[6] ..... H01R 13/44

[52] U.S. Cl. ..... 439/136; 439/135

[58] Field of Search ..... 439/136, 135, 439/456, 457, 458, 373

[56] References Cited

U.S. PATENT DOCUMENTS

| | | | |
|---|---|---|---|
| 4,734,055 | 3/1988 | Misu | 439/456 |
| 4,952,160 | 8/1990 | Olsen | 439/373 |
| 5,067,907 | 11/1991 | Shotey | 439/135 |
| 5,488,208 | 1/1996 | Seewald | 439/135 |

*Primary Examiner*—Gary Paumen
*Assistant Examiner*—Alexander Gilman
*Attorney, Agent, or Firm*—Scott B. Garrison; Lambert & Garrison PLLC

[57] ABSTRACT

This invention is concerned with safety devices which prevent children from accessing electrical outlets. It is designed to be easy to install, easy to use, and most importantly, safe. It is designed to have a cover which replaces the standard outlet cover found on electrical outlets. Attached to the cover is a removable cover which slides into place and affirmatively locks. To disengage the device, some manual dexterity and strength is required. The locking mechanism must be pushed with a requisite degree of spring force to enable the cover to disengage. The pathway which the electrical cord follows to access the interior of the apparatus is curved and non-linear so that it cannot be easily probed with a foreign object.

1 Claim, 6 Drawing Sheets

ELECTRICAL OUTLET SAFETY DEVICE

CROSS REFERENCE TO RELATED APPLICATIONS

This application claims the benefit in the form of a continuation-in-part under 37 CFR 1.53(b)(1) of parent application Ser. No. 08/780,874 filed Jan. 9, 1997 by the same inventor, now abandoned.

BACKGROUND OF THE INVENTION

The present invention relates to the field of electrical safety devices. More particularly, it relates to an improved electrical wall outlet and electrical plug safety device. Injuries to people, especially infants and toddlers, from accidental shock is often due to intentional playing or accidental exposure to electrical wall outlets and electrical plugs partially withdrawn from these outlets. It is a well known fact that children are drawn to such plugs and outlets, and parents or guardians cannot always protect curious children from all dangers including the potential danger of electricity. Typically children will attempt to place their fingers or a foreign object into the electrical prong slots. The danger that this poses is obvious. However, not so obvious is the equally dangerous practice of being exposed to a partially withdrawn electrical plug. Often times children, parents or simply normal activity will cause or result in a plug being partially withdrawn from an electrical socket, thereby exposing the prongs of the electrical cord which if in contact with the electrical conductors within the electrical socket will be live.

A number of solutions to this problem have been used in the past. The specific solutions which the Applicant has knowledge of, and which appear at least outwardly viable include the insertion of plastic, or simply non-conductive electrical plug prong inserts into the electrical wall outlet. This solution completely seals the receptacle to children. In essence, the non-conducting insert is inserted into the wall outlet as if it were an electrical plug. Instead of wires leading to some appliance, the insert simply ends and is constructed to have a shallow profile, making it difficult for a child to remove it from the outlet. The problem with this solution is that these inserts are difficult to remove even for adults due to their tight fit with respect to the outlet and shallow profile making it difficult to establish a grip from which to withdraw the insert from the wall outlet. In addition they make the outlet itself useless as it can no longer accept a plug from an electrical outlet. Another problem is that they do not prevent a child from withdrawing or partially withdrawing a plug, thereby revealing an accessible or unprotected socket or creating the hazard discussed above. Another currently available solution to the problem is to make integral with the wall outlet electrical socket, a sliding mechanism that seals the electrical prong slots upon removal of the electrical plug. The main disadvantage with this is that it provides no protection from electrical shock from a partially withdrawn, electrically engaged plug. A child could still receive a shock or get electrocuted by contact with the partially withdrawn plug, since with any amount of the plug engaged, the sliding mechanism cannot seal the electrical prong slots.

A third currently available solution is to provide a dedicated assembly which is placed over the entire wall socket and attaches thereto. This device is provided with two access openings, typically in the bottom. This mechanism requires the electrical cord to be inserted first through the access openings and then inserted normally into the electrical socket plug receptacles. The device simply retains and isolates the plug from inadvertent access. The problem with devices of this nature is that when the user desires to remove the plug from the outlet, he or she would have to unscrew the device prior to being able to unplug it. It is unlikely that anyone but the most meticulous home owner would consistently install this device. Additionally, in the event of an electrical overload by a faulty appliance for instance, the user would not be able to disengage power to the appliance without either disassembling the device or throwing the main circuit breaker. Furthermore, with the device in place but no electrical cord engaged, access can still be had to the electrical outlet from the bottom through the vacant access opening.

SUMMARY OF THE INVENTION

What is needed is a safety device which effectively denies a child access to an electrical outlet. The device should be safe, simple in construction, simple in use, and cost effective both to the homeowner and to the manufacturer. In addition there should be no available access to the live portion of the socket whether the outlet is being used or is alternatively left unoccupied by a plug.

According to the preferred embodiment of the above-mentioned U.S. patent application Ser. No. 08/780,874, an electrical outlet safety device is made by providing a cover which locks into place for each electrical socket. The preferred locking mechanism comprises narrow extruded elements or locking tabs having spring-like characteristics in that a pressure is required to compress the tabs one toward the other while simultaneously pulling the cover from the electrical socket. Although an electrical safety outlet device produced in accordance with U.S. patent application Ser. No. 08/780,874 possesses all the attributes desired, there are certain aesthetic or economic disadvantages associated with it due to the need for a cover for each electrical socket. Additionally, the claimed invention herein provides additional features not disclosed in the parent application.

The present invention relates to an apparatus which is essentially the same as the apparatus described in the aforementioned application. However, the cover and locking mechanism have been improved to an extent which further eliminates the possibility of a child accessing the electrical socket. As in the previous application, the Applicant's invention prevents access to the electrical outlet regardless of whether it is occupied by a plug or left vacant, albeit it is an improvement on the previous application. It is accomplished by installation of a base plate that, with the addition of its cover, forms a housing that prevents access to both electrical sockets. Though nothing can be 100% secure this invention substantially improves upon aspects of the parent application making it virtually childproof and safe, while yet maintaining instant accessibility for adults.

The device employs a non-linear passage into the unit by placing an obstruction within the passage thereby partially blocking access to the interior of the device. This obstruction performs a function similar to that of the safety wall in the former device. Dead end traps effectively prevent access to the live electrical socket unless the cover is removed. Removal of the cover is designed to be performed by a person with both the requisite strength and dexterity found in an adult or older child, i.e., one with sufficient mental capacity to understand the dangers of electricity. It is therefore an object of the present invention to provide a novel means to completely prevent an infant or toddler from gaining access to an electrical outlet.

It is a further object of the present invention to prevent such access yet allow easy use of a protected outlet by an adult or other responsible person.

It is a further object of the present invention to provide a device that protects the child from electricity in the electrical outlet whether the outlet is in use or not.

It is another object of the present invention to provide a locking mechanism capable of manipulation by an adult but requiring more strength than found in the typical child.

It is yet another object of the present invention to provide a device which is easy to manufacture, cost effective to produce, cost effective to the average homeowner, and most importantly, safe and reliable.

BRIEF DESCRIPTION OF THE DRAWINGS

The novel features considered characteristic of the invention are set forth in the appended claims. The invention itself, however, both as to its proper construction and its method of operation, together with additional objects and advantages thereof, will best be understood from the following description of the specific embodiments when read and understood in connection with the accompanying drawings.

DETAILED DESCRIPTION OF THE PREFERRED EMBODIMENT

Figure 1:
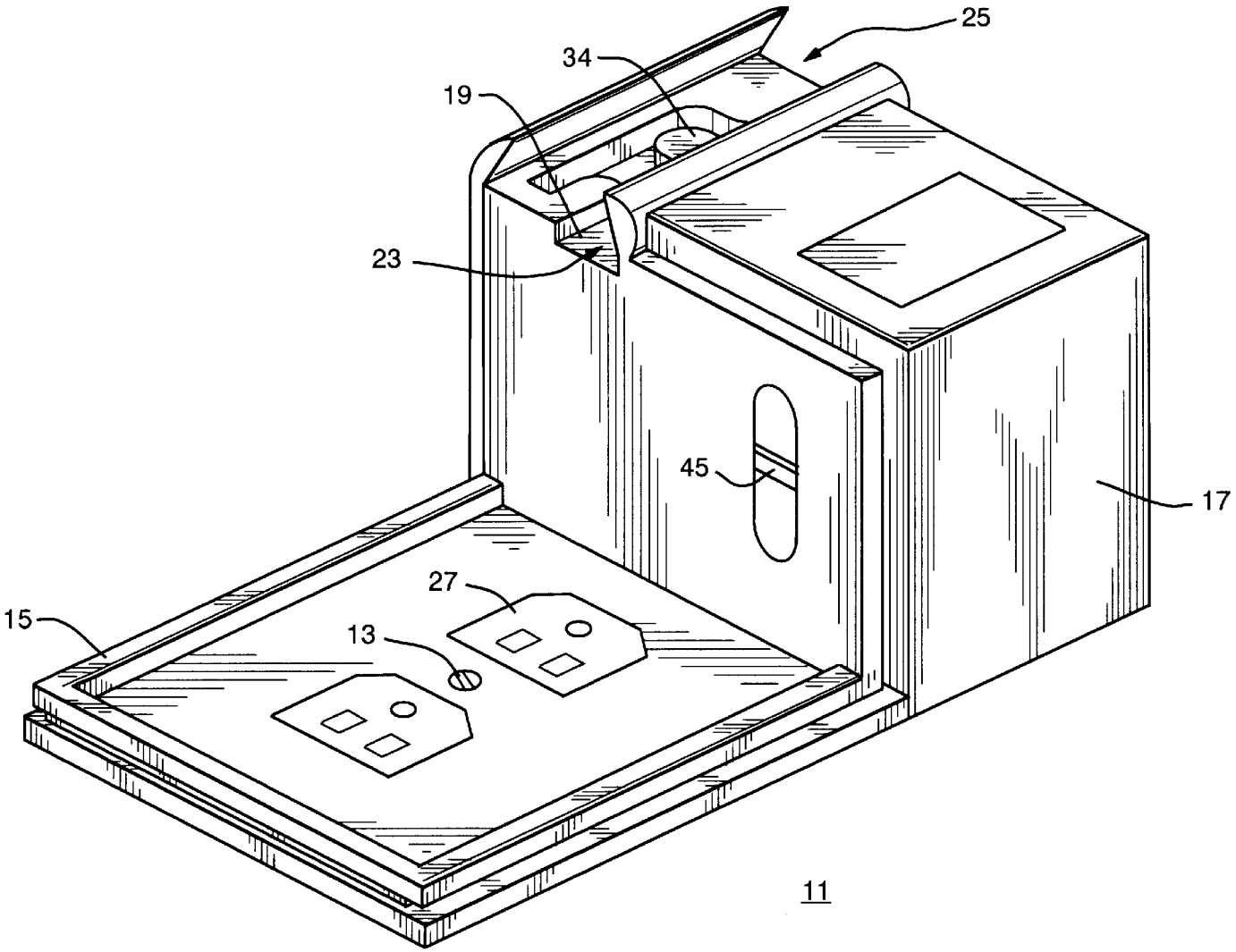
FIG. 1 is three quarter perspective view of a base plate comprising one portion of a preferred embodiment of a electrical outlet safety device.

Now referring specifically to FIG. 1, one embodiment of a base plate referred to generally as 11 is shown. In one preferred embodiment of the subject invention, the base plate 11 is fastened to a standard electrical outlet by a standard screw 13 typically associated with such outlets and commonly used to secure an electrical outlet face plate to a wall. In another embodiment, an anchor (not shown) can be used to fasten the base plate 11 to a standard electrical outlet. The anchor would perform the same function as screw 13 but would be raised away from the outlet surface thereby providing potentially greater stability to the base plate 11 as well as providing a method of securing the base plate 11 to the electrical outlet without requiring the use of tools since the anchor would be large enough for a person to grip and engage with the standard screw hole in which screw 13 would otherwise engage.

Figure 5:
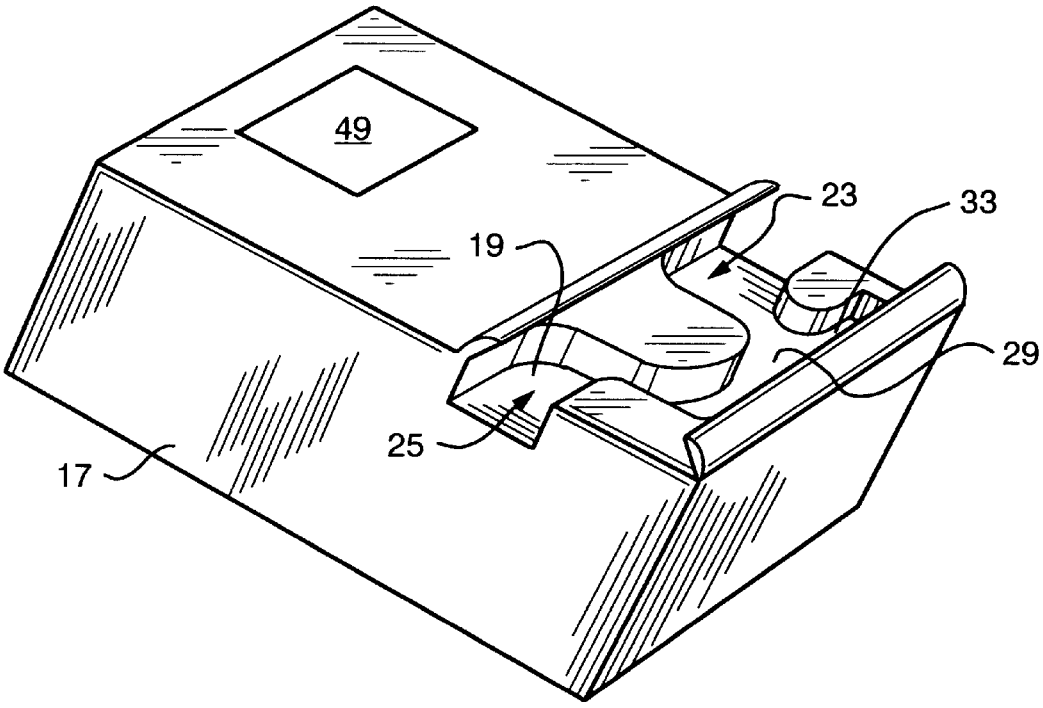
FIG. 5 is a three quarter perspective view of the body portion of the FIG. 1 base plate depicting an alternate embodiment of the channel and obstruction.

Specifically FIG. 1 depicts base plate 11 as comprising two main portions. The first comprises a cantilevered lip portion 15 which runs along each of two sides of the base plate 11, optionally said cantilevered lip portion 15 can run along an end of said base plate 11. The second comprises a body portion 17 which is simply a structure containing an electrical cord entryway 19 and part of a locking mechanism 21, infra, best illustrated on FIGS. 6, 7, and 8. The cord entryway 19 depicted on FIGS. 1, 5, and 6 further comprises an entrance 23 and an exit 25 as viewed from within the device under an assembled condition. Disposed between said entrance 23 and said exit 25 is at least one cord passage or channel 29. Preferred embodiments have a dedicated channel 29 for each electrical socket 27. However, as shown on FIG. 5, one such channel 29 would suffice for the purpose of the invention. It should be noted, that the remainder of the embodiment described makes reference to a two socket electrical outlet.

Inasmuch as this is understood, each channel 29 comprises an offset or displaced passage through the cord entryway 19, each of said channels 29 being capable of receiving an electrical cord. The channels 29 are formed in the cord entryway 19 by placement of an obstruction 31 therein. The obstruction 31 should be wider than both the exit 25 and the entrance 23. All that the obstruction does is create a nonlinear path between the exit 25 and the entrance 23. Furthermore, each channel 29 preferably also contains at least one dead end 33. Each dead end 33 is designed to catch, snag or otherwise prevent a flexible or bendable object inserted into exit 25 from accessing the internal cavity of the device. Specifically the dead ends 33 reduce the likelihood of a foreign object being slid along a wall of channel 29 thus gaining access to the interior of the device. In effect, the obstruction 31 along with dead ends 33, reduces the opportunity for objects to be probed into the standard electrical outlet area since the design of the obstruction 31, and the dead ends 33 make it very difficult for the admission of foreign objects. However, the arrangement described still allows the cord to gain access to the area with ease. To best illustrate the use of the device, an appropriate example is needed. In the event that a rigid object, such as but not limited to scissors, pins, needles, pens, nails, etc., were placed into the exit 25, the object would run into the obstruction 31 located in the middle of the channel 29 thereby terminating the object's travel. On the other hand if the object inserted into exit 25 were flexible enough to avoid obstruction 31, it would be exceedingly difficult to avoid the dead ends 33 and continue into the electrical socket. Whereas proper access for an electrical cord could still be had through the entrance 23, around either side of an obstruction 31 thus through one of the channels 16, and out the exit 25. Of course the device is not foolproof, but the applicant considers the described features to be sufficient to prevent those who the device is intended to protect, i.e., children, from electrical exposure.

Figure 2:
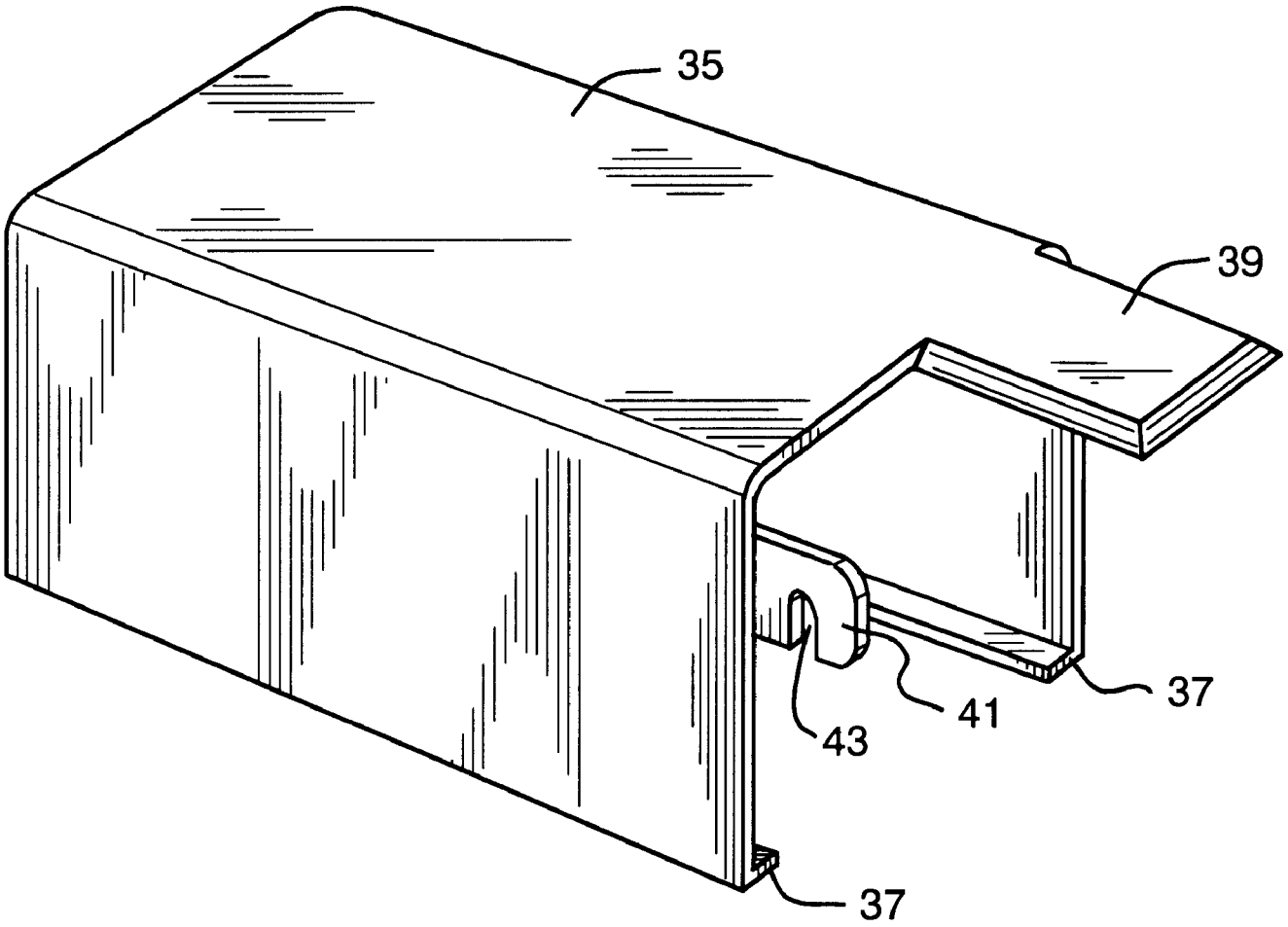
FIG. 2 is a three quarter perspective view of a cover portion which mates with the FIG. 1 base plate.
Figure 3:
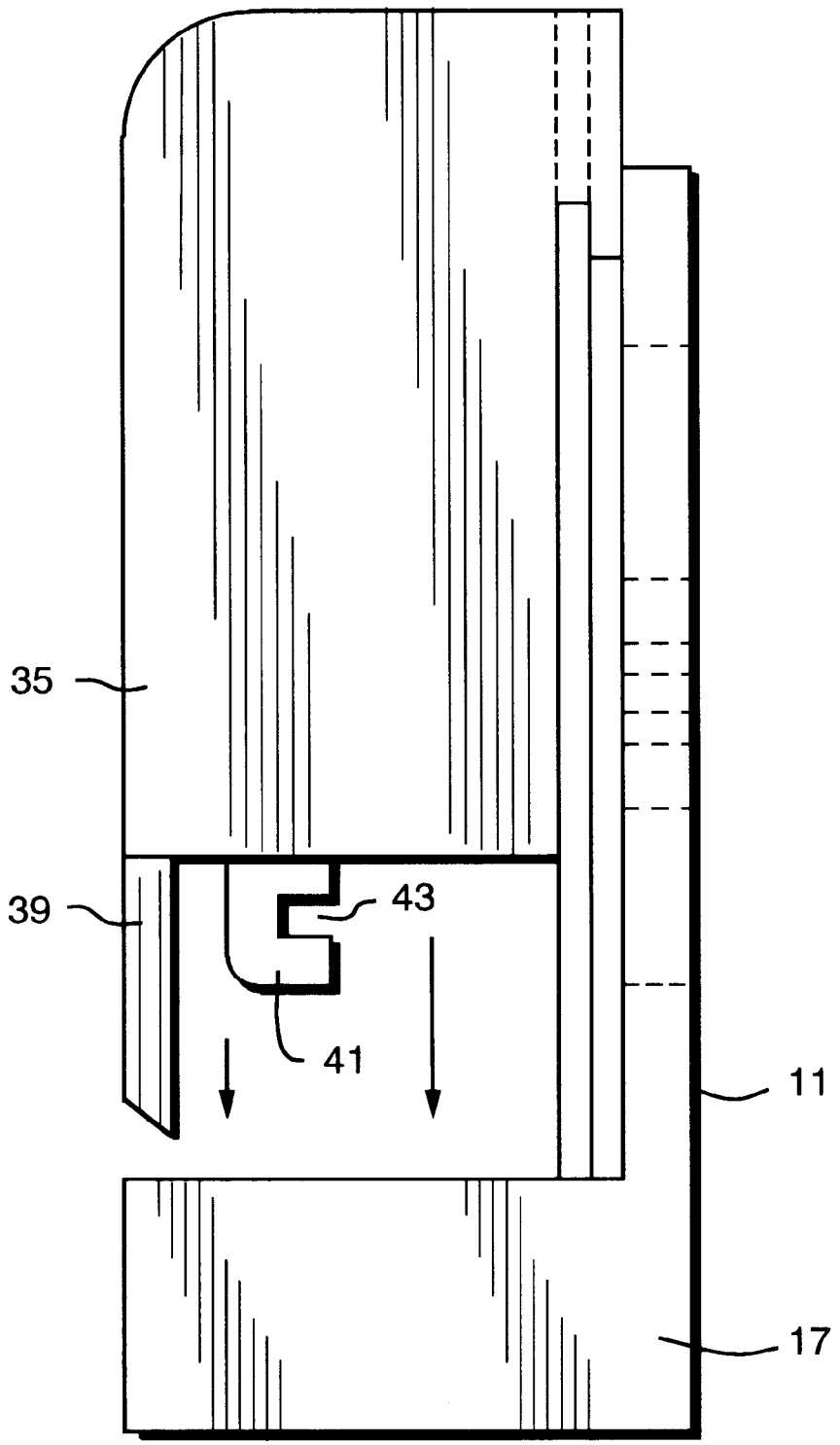
FIG. 3 is a side elevation of the FIG. 2 cover engaging the FIG. 1 base plate.
Figure 4:
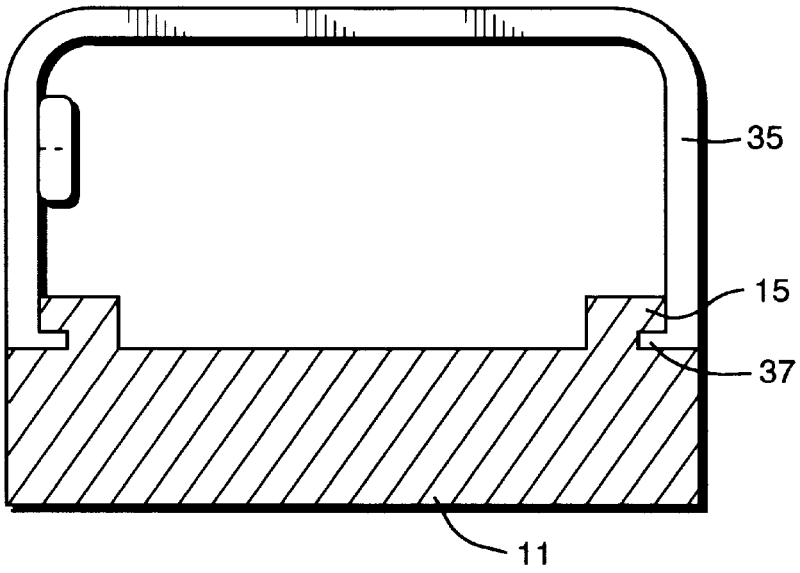
FIG. 4 is a partial view of the FIG. 1 base plate depicting the body portion of the base plate.

FIGS. 2 and 3 illustrate a cover portion 35. The cover portion 35 includes a lip receiving protrusion 37 around that portion of the perimeter of the cover portion 35 designed to mate with the cantilevered lip portion 15 of the base plate 11. In the preferred embodiment this would be said cover portion 35 sides. As shown on FIG. 4, the lip receiving protrusion 37 extends inward into the interior of the base of the cover portion 35 to enable it to slidingly engage with the base plate 11. This lip receiving protrusion 37 interlocks with the cantilevered lip portion 15 in the base plate 11 together forming a sliding joint which prevents an object from entering the side. Additionally, the joint's configuration makes it improbable that the cover portion 35 can be non-destructively removed from the base plate 11 in any way but the intended way. It should be apparent that by simply sliding the cover portion 35 from the base plate 11 in a direction opposite the direction which engages the two pieces, the base plate 11 and the cover portion 35 would be free of each other.

The cover portion 35 also must contain an electrical cord entryway cover 39 which completely overlaps the electrical cord entryway 19 leaving only exit 25 accessible from the exterior of the device. It is preferred that electrical cord entryway cover 39 be made to engagingly slide over the electrical cord entryway 19 so that the electrical cord entryway cover 39 cannot easily be levered in such a way so as to provide access to the channel 29. A sliding joint such as described above between the lip receiving protrusion 37 and the cantilevered lip portion 15 would suffice. However, a simple beveled edge as shown in FIGS. 1 and 2 is considered satisfactory and is presently the preferred embodiment due to its simplicity. With the lip receiving protrusion 37 and the cantilevered lip portion 15 properly engaged and the electrical cord entryway cover 39 slidingly overlapping the electrical cord entryway 19, the entire structure is provided with both increased strength and rigidity. In addition the interlocking of the pieces forms a positive lock preventing the intrusion of any objects into the standard electrical outlet from the sides and top of the housing.

Figure 6:
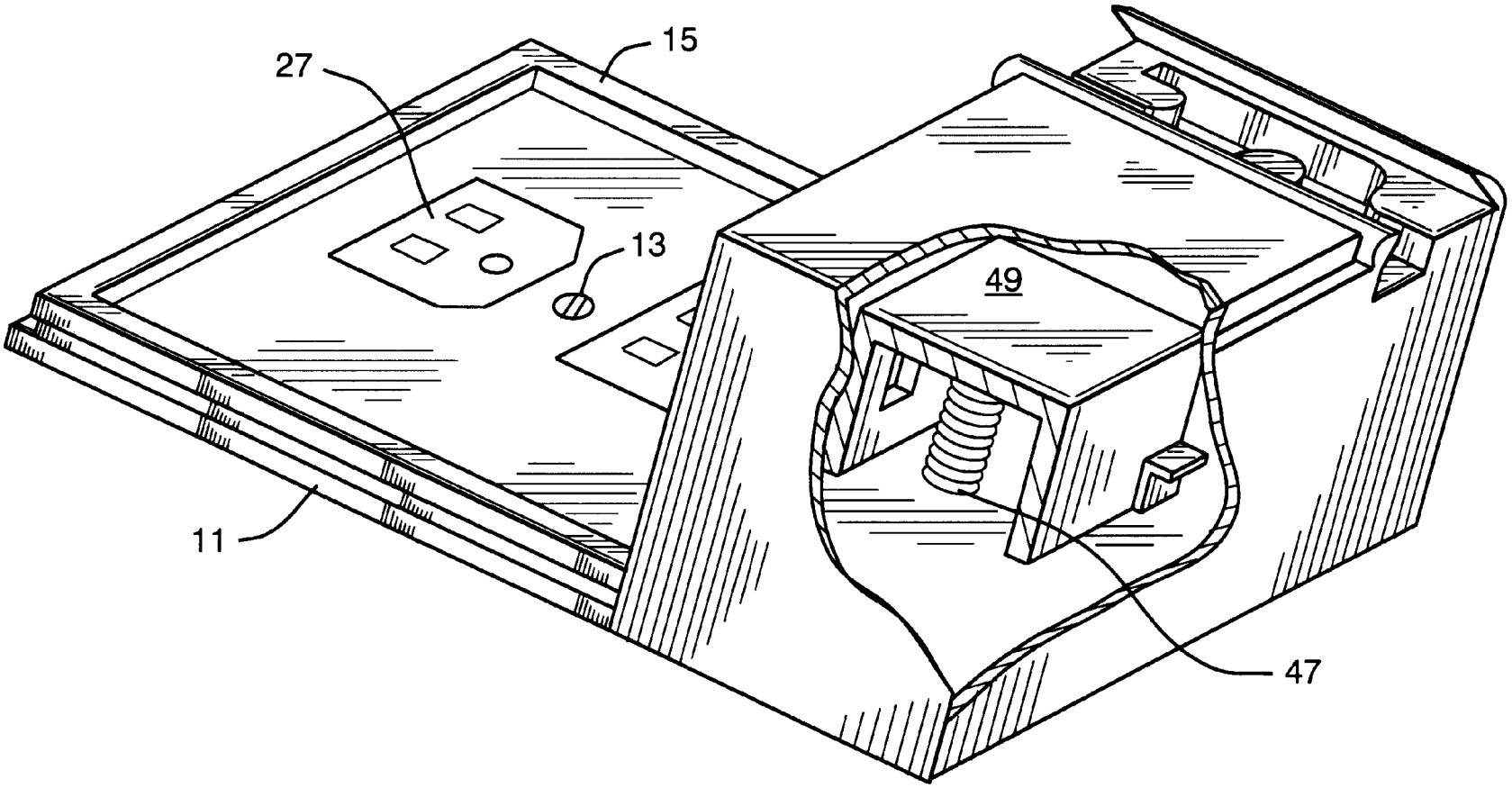
FIG. 6 is a three quarter perspective view of the FIG. 1 base plate with a cutaway depicting a preferred locking mechanism.
Figure 7:
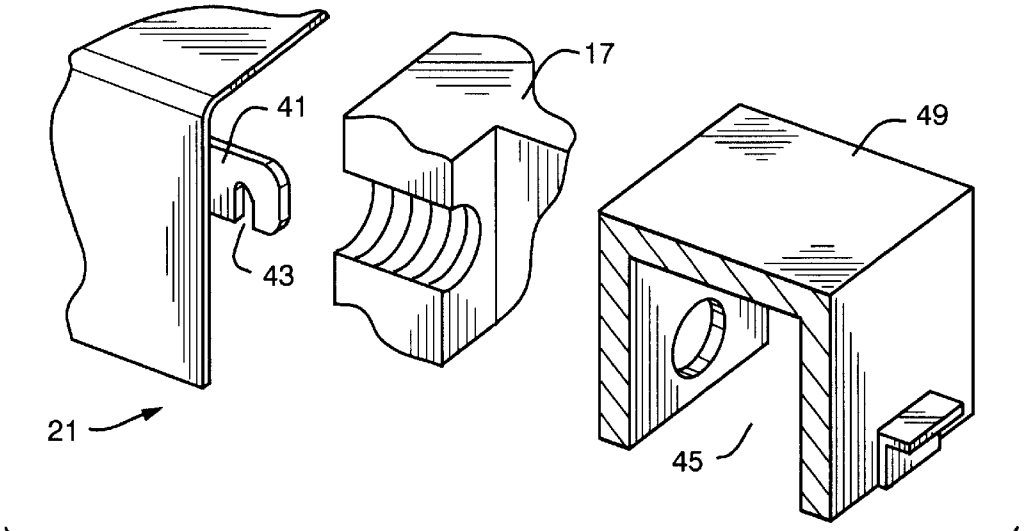
FIG. 7 is an exploded illustration of the components of the locking mechanism showing their relationship with one another.
Figure 8:
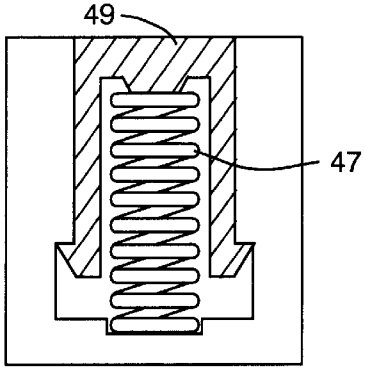
FIG. 8 is a cutaway section of a preferred embodiment of the release mechanism.

In order for the previously described elements to lock in a positive fashion to prevent a child from simply sliding the elements apart as intended, a locking mechanism 21 is necessary. FIGS. 6, 7, and 8 are depictions of such a preferred locking mechanism, however partial aspects of the mechanism are visible in some of the other FIGs. as well. FIGS. 2, 3, 4, and 7 depict from varying perspectives a preferred locking tab 41. The locking tab 41 protrudes from the cover portion 35 and contains a notch or slot 43 which engages a catch 45 contained within the body portion 17 of the base plate 11; best depicted in FIG. 1. Once the slot 43 portion of the locking tab 41 engages the catch 45, the cover portion 35 cannot be removed since it no longer is able to slide at the interface of the lip receiving protrusion 37 and the cantilevered lip portion 15. However, by providing the ability to release the locking tab and the catch, the device can be made to both lock and unlock at a homeowner's whim.

In order to prevent children from being able to lock and unlock the device, a suitable release mechanism is needed which is not ordinarily operable by a young child. Though many such release mechanisms can be utilized, the Applicant considers the use of a suitably sized spring mechanism to be preferred. The spring mechanism would have to possess a stiffness or spring constant which can be overcome by an adult but is unlikely to be overcome by a child. Applicant considers a spring force of about 15 pounds to be sufficient. As such, a cutaway view from FIG. 6 depicts Applicant's preferred embodiment which comprises a spring 47 disposed below a release mechanism 49 both contained within said body portion 17 of the base plate 11. The release mechanism 49 in the depicted embodiment also can be utilized as the catch 45 by relieving a portion of one sidewall of the release mechanism 49 to a sufficient degree to enable the locking tab 41 to internally engage the relieved portion of the sidewall thereby enabling the sidewall to engage the slot 43.

The Applicant is aware of the various embodiments of the device that may be created. As such, Applicant has set out to describe the best mode as it is currently believed. However, Applicant considers electrical socket safety devices contemplated by him to have three main features. The first being the sliding fit between a cover and a base plate such that the two slide together in one direction and apart in an opposite direction. The second feature comprising a non-linear access from without the device to within the device for at least one electrical cord. The third being a locking mechanism which is simple for the adult to use and difficult for a child to use since the typical child has neither the strength nor the dexterity to unfasten the locking mechanism. While the invention has been described and illustrated with reference to a specific embodiment, it is understood that other embodiments having the three requisite features may be resorted to without departing from the invention. Therefore, the form of the invention set out above should be considered illustrative and not as limiting the scope of the following claims:

I claim:

1. An electrical outlet safety device comprising:

a base plate having an interior area and an exterior perimeter; said base plate adapted to rigidly mount to an electrical outlet, a cover which slidingly engages with said base plate, substantially covering said interior area of said base plate;

means for releasably securing said cover to said base plate comprising a biasing spring, wherein said biasing spring requires the application of about 15 pounds force to enable separation of said cover from said base plate; and an access through the combination of said base plate and said cover from without said exterior perimeter to within said interior area, said access being non-linear and adapted to allow passage of at least one electrical cord therethrough.

* * * * *